US007163140B1

(12) United States Patent
Kaiser

(10) Patent No.: US 7,163,140 B1
(45) Date of Patent: Jan. 16, 2007

(54) ROADSIDE MAILBOX AND METHOD

(76) Inventor: Patrick G. Kaiser, 4191 Parker Rd., Davisburg, MI (US) 48350

( * ) Notice: Subject to any disclaimer, the term of this patent is extended or adjusted under 35 U.S.C. 154(b) by 0 days.

(21) Appl. No.: 11/336,573

(22) Filed: Jan. 23, 2006

(51) Int. Cl.
*A47G 29/12* (2006.01)

(52) U.S. Cl. ..... 232/38; 232/39; 52/720.2

(58) Field of Classification Search ..... 232/45, 232/17, 39, 38; D99/29–32; 52/720.2, 736.1, 52/103
See application file for complete search history.

(56) References Cited

U.S. PATENT DOCUMENTS

| | | | | | |
|---|---|---|---|---|---|
| D265,859 | S | * | 8/1982 | Gross | D99/32 |
| 4,875,622 | A | * | 10/1989 | Lents | 232/39 |
| D337,415 | S | * | 7/1993 | McDowell | D99/29 |
| 5,361,977 | A | * | 11/1994 | Ogrodnick, Jr. | 232/39 |
| D410,849 | S | * | 6/1999 | Grimes | D99/29 |
| 5,938,113 | A | * | 8/1999 | Kim | 232/47 |
| 6,109,519 | A | * | 8/2000 | McClure | 232/17 |
| 6,123,257 | A | * | 9/2000 | Guidicy | 232/17 |
| 6,234,387 | B1 | * | 5/2001 | Cuthbert et al. | 232/29 |
| 6,244,505 | B1 | * | 6/2001 | Grimes et al. | 232/47 |
| 6,347,737 | B1 | * | 2/2002 | Madruga | 232/47 |
| 6,644,543 | B1 | * | 11/2003 | Cox et al. | 232/47 |
| 2004/0195303 | A1 | * | 10/2004 | Hunt et al. | 232/34 |
| 2004/0244329 | A1 | * | 12/2004 | Delantar, Jr. | 52/720.2 |
| 2006/0113368 | A1 | * | 6/2006 | Dudley | 232/31 |

* cited by examiner

*Primary Examiner*—William L. Miller
(74) *Attorney, Agent, or Firm*—Alex Rhodes

(57) ABSTRACT

A pre-fabricated lightweight roadside mailbox structure having an inner core made of a rigid foam material, a capital joined to the inner core, a reinforcing cloth adhesively joined to the inner core and a decorative outer coating for simulating the appearance of an immovable massive roadside mailbox. A first horizontal aperture extends into the mailbox for receiving a mail enclosure, a second horizontal aperture extends into the mailbox for receiving a newspaper and a vertical aperture upwardly from a bottom of the mailbox for mounting the mailbox on a square post. The inner core is comprised of a rigid foam base and a rigid foam mailbox housing adhesively joined to the base.

8 Claims, 4 Drawing Sheets

ROADSIDE MAILBOX AND METHOD

FIELD OF THE INVENTION

This invention relates to mailboxes and more particularly to a pre-fabricated lightweight roadside mailbox and method.

BACKGROUND OF THE INVENTION

Roadside mailboxes with brick and stone facades are massive immovable masonry structures. They are located at the sides of roads, adjacent to entrances of driveways of buildings and residences. They are erected by skilled bricklayers and stone masons using brick, stone, concrete and precast cement materials. They are aesthetically pleasing and complement the architecture of residences and buildings.

One drawback of massive masonry mailboxes is that they are rigid immovable structures which are hazardous to vehicles and vehicle occupants. Another drawback is that they are prohibited in many municipalities. Another drawback is that they shift, tilt and crack under frost and uneven ground conditions.

SUMMARY OF THE INVENTION

With the above drawbacks in mind, the present invention provides a number of benefits. One benefit is that it reduces property damage and occupant injuries from vehicle impacts. Another benefit is that it is relatively low in cost. Another benefit is that it can be immediately installed. Another benefit is that it is easily installed. Another benefit is that it can be installed by a homeowner or an unskilled worker. Another benefit is that it is neither affected by frost nor uneven ground. Another benefit is that it provides a structure for mounting accessories such as addresses and lights. Another benefit is that a wide range of appearances can be provided without increasing manufacturing and inventory costs.

The invention comprises a rigid plastic foam base, mailbox housing, capital, cover, and cement aggregate coating. The base has a vertical aperture for receiving a ground post. A pair of horizontal apertures extend through the mailbox housing for receiving a mailbox and newspapers. Lamp and address panel accessories are available for mounting on the mailbox housing.

In employing the teaching of the present invention, a plurality of alternate constructions can be provided to achieve the desired results and capabilities. In this disclosure, only several embodiments are presented for the purpose of disclosing our invention. However, these embodiments are intended as examples only and should not be considered as limiting the scope of my invention.

The foregoing features, benefits, objects and best mode of practicing the invention and additional benefits and objects will become apparent from the ensuing detailed description of a preferred embodiment and the subject matter in which exclusive property rights are claimed is set forth in the numbered claims which are appended to the detailed description of the preferred embodiment.

BRIEF DESCRIPTION OF THE DRAWINGS

The invention will be better understood and further objects, characterizing features, details and advantages thereof will appear more clearly with reference to the diagrammatic drawings illustrating a presently preferred specific embodiment of the invention by way of non-limiting example only.

DETAILED DESCRIPTION OF A PREFERRED EMBODIMENT

Figure 1:
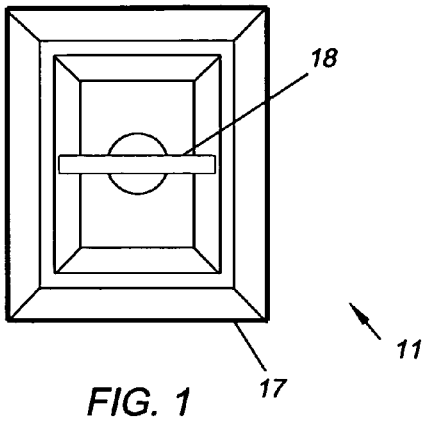
FIG. 1 is a plan view of a mailbox according to my invention.
Figure 2:
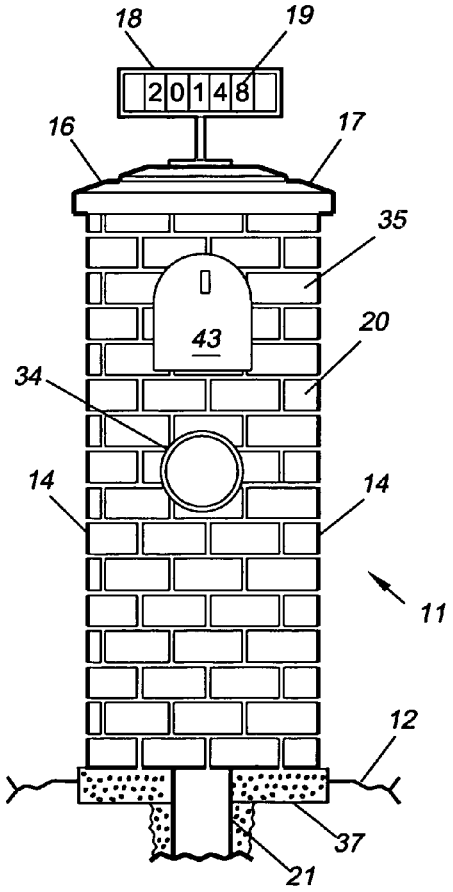
FIG. 2 is a front elevational view of the mailbox.
Figure 3:
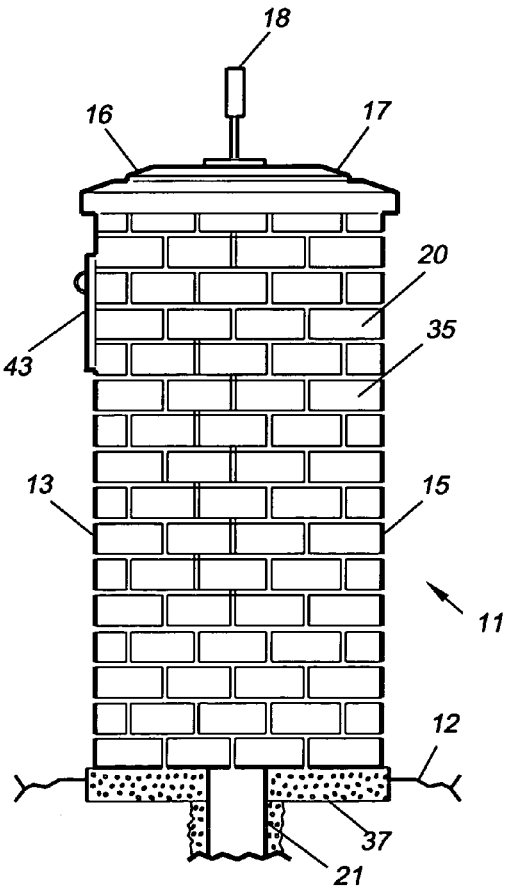
FIG. 3 is a left elevational view of my invention.
Figure 7:
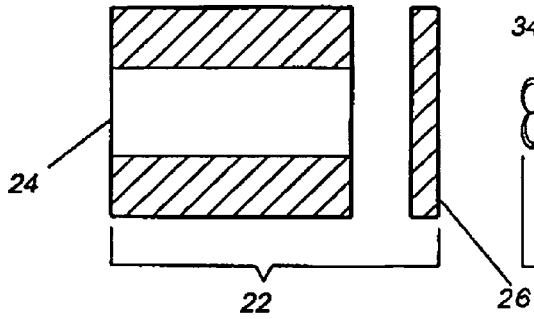
FIG. 7 is a cross-sectional view taken on the line 7—7 in FIG. 5.
Figure 6:
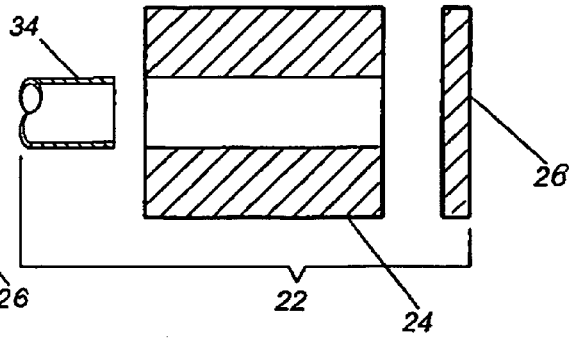
FIG. 6 is a cross-sectional view taken on the line 6—6 in FIG. 5.
Figure 4:
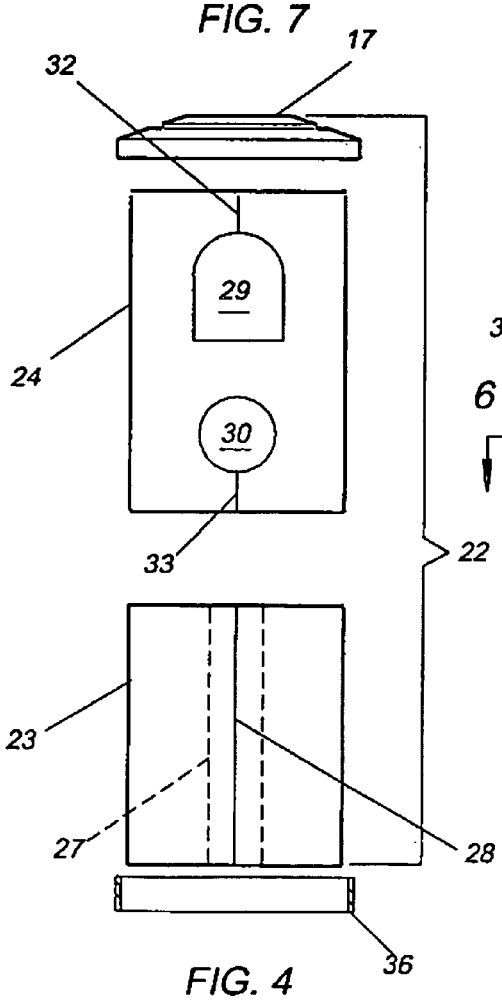
FIG. 4 is an exploded front view of a rigid form core of the mailbox shown in FIGS. 1–3.

Referring now to the drawings wherein like numerals designate like and corresponding parts throughout the several views, in FIGS. 1 through 3, a roadside mailbox 11 is shown according to the present invention. The mailbox 11 is a rectangular vertical structure that extends upward from a ground surface 12. The front 13, sides 14, and rear 15 of the mailbox 11 simulate a brick roadside mailbox structure. The top 16 of the mailbox is crowned with a capital 17 made of simulated stone. An address bracket 18 and address 19 are mounted on the capital 17. The brick 20 of the mailbox 11 complements the appearance of a home (not shown) and simulates the appearance of an immovable, massive, and expensive mailbox.

The mailbox 11 is supported on a 4.00 inch square post 21. The post 21 extends downwardly, preferably below a frost line if freezing temperatures are encountered. One feature of the mailbox 11 is that it has a lightweight core 22 made of a rigid plastic foam, such as rigid polystyrene foam. The foam core 22, as shown in FIGS. 4 through 7, consists of a rectangular base 23, a rectangular mailbox housing 24, a capital 17 and a rear cover 26. The core members are cut in a usual manner from blocks of rigid plastic foam with hot wires.

Typical sizes of the core members are as follows. The base 23 is 16 inches wide by 20 inches deep by 24 inches high. The mailbox housing 24 is 16 inches wide by 18 inches deep by 24 inches high. The rear cover is 26 inches thick by 24 inches high by 16 inches wide. The capital 17 overhangs the front 13, sides 14 and rear 15 of the mailbox housing 24 and is 18 inches wide by 22 inches deep by 3 inches high.

Figure 5:
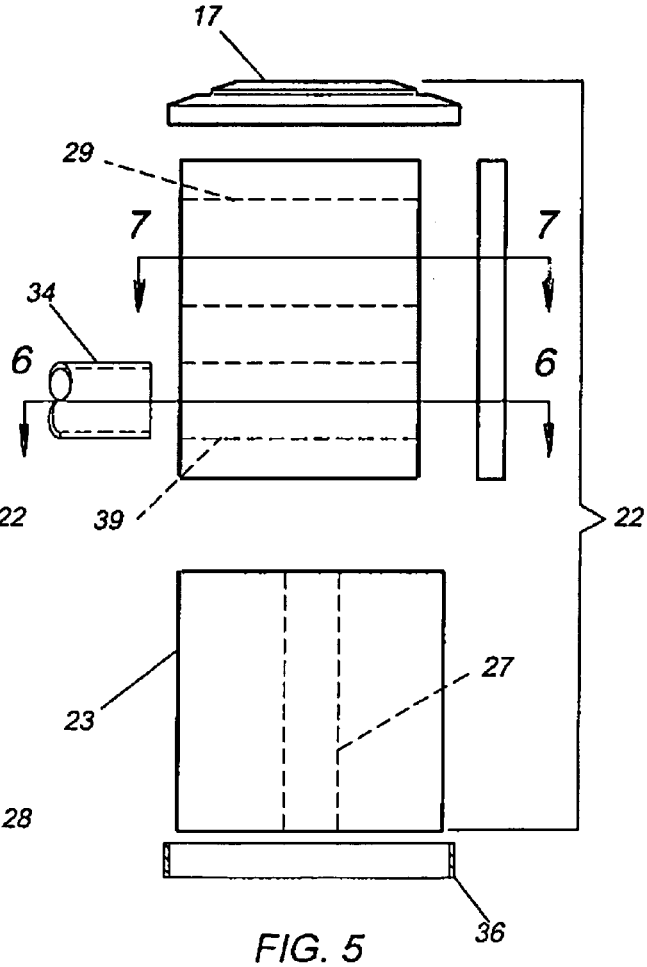
FIG. 5 is an exploded left side view of the rigid foam core.

As shown in FIGS. 2 and 3, a rectangular aperture 27 extends upwardly through the center of the base 23 for receiving a 4.00 inch square ground post 21. With reference to FIG. 5, the hot wire enters the base along the line 28 in FIG. 5 to cut the aperture 27 for the ground post 21. A pair of horizontal apertures 29, 30 extend through the mailbox housing 24 to receive a standard metal or plastic mailbox 43 and newspaper (not shown). The wires which cut the apertures 29, 30 enter the mailbox housing 24 along the lines 32 and 33 in FIG. 4. In lieu of cutting the base 23, mailbox housing 24, rear cover 26 and capital 17 from rigid foam blocks, they may be formed in molds with expanded polystyrene plastic (EPS). EPS is a cellular foam plastic.

Figure 11:
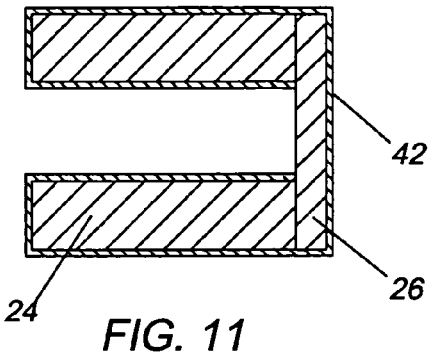
FIG. 11 is a cross-sectional view taken on the line 11—11 in FIG. 9.
Figure 10:
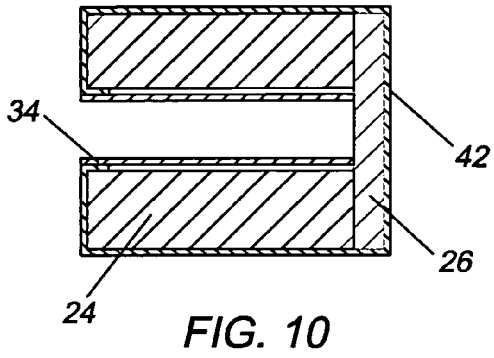
FIG. 10 is a cross-sectional view taken on the line 10—10 in FIG. 9.
Figure 8:
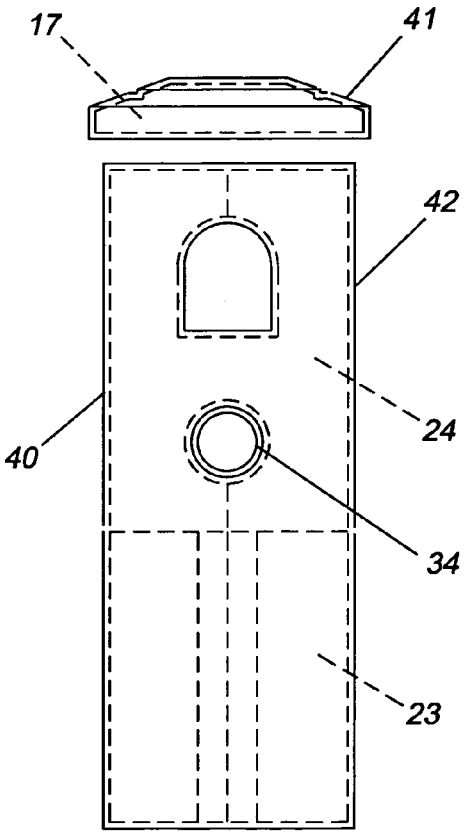
FIG. 8 is an exploded front view of a sub-assembly of the rigid foam core.
Figure 9:
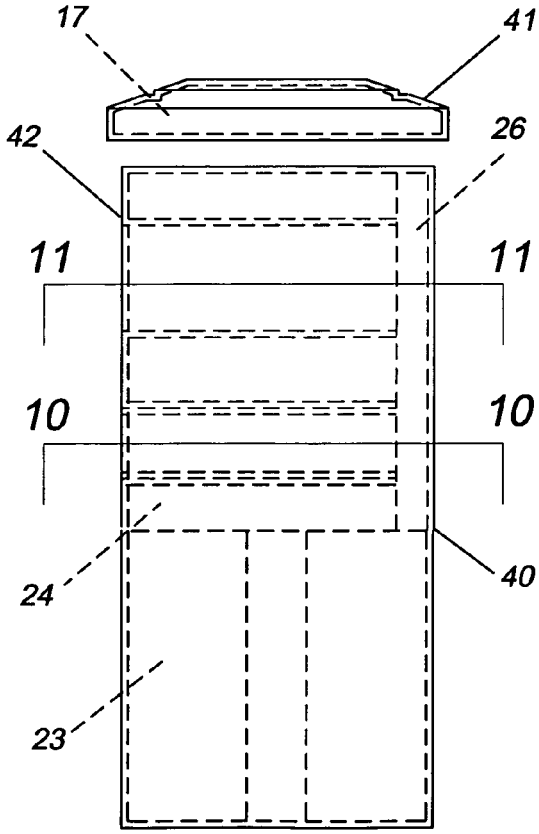
FIG. 9 is an exploded left side view of the sub-assembly of the rigid foam core.

With reference to FIGS. 9 through 11, after the base 23, mailbox housing 24, rear cover 26 and capital 17 are formed, the base 23 and mail box housing 24 are adhesively joined together to form a sub-assembly 40 and a reinforcing cloth 42 is adhesively applied to the exterior surfaces of the sub-assembly 40. The reinforcing cloth 42 is adhesively applied to the capital 17 and the tube 34 is adhesively bonded inside aperture 30. The final steps consist of applying decorative finishes to exterior surfaces and joining the capital 17 to the assembly of the base 23 and mailbox housing 24.

A colorant is mixed with a cement type coating and a thin (base) coating of the mixture is sprayed or troweled over outer surfaces of the base and housing sub-assembly 40 and capital 17 and allowed to dry. Drying can be accelerated by placing the parts in a warm air oven for several minutes. The thin coating is used to simulate grout between stone and brick. After the base coating has dried, stencils having cut-outs which simulate spaces between bricks or stones are attached to the outer surfaces of base and housing sub-assembly 40 and a thick coating of a mixture of a cement type coating and colorant is applied over the stencil to simulate a brick, stone or other surface. The thicker coating may be up tp 1.00 inch thick. The stencil is removed and the capital 17 is adhesively joined to the decorated base and housing sub-assembly 40 and the gap between the capital 17 and decorated sub-assembly 40 is sealed with a suitable sealer. The stencils are removed to simulate the grout lines between the bricks and stones.

The coating may be a traditional stucco coating or one of the recently introduced plastic base finishes. One suitable plastic base finish is available from Dryvit Systems, Inc. of West Warick, R.I. Dryvit finishes are available in a wide range of decorative finishes. The Dryvit finishes are composite finishes containing acrylic polymers, Portland cement plaster, stucco and fiber modified plasters, or stone aggregates. By way of example, the "Amerstone™" Dryvit finish is a 100% acrylic-based finish with multi-colored quartz aggregates. A 4.00 inch high cardboard frame is supplied with the finished mailbox which is used for installing the mailbox.

Before applying a Dryvit coating, the manufacturer recommends that the "substrate" (mailbox) be clean, free of oil, grease and dirt, salts, etc. and should be dampened. The following is exemplary of a procedure for applying a Dryvit coating, specifically the Dryvit AC-100 coating with Portland cement plaster or one-coat stucco. For Portland cement plasters and stucco, one part AC-100 coating is pre-blended with 2 to 3 parts water. After mixing the pre-blended mixture with Portland cement plaster or one-coat stucco and aggregates, the mixture is applied in the same manner as an unmodified mixture.

The mailbox 11 is installed as follows. A hole is dug for the 4.00 inch post 21 and the post 21 is installed in the hole. The gap between the 4.00 inch post 21 and hole is filed with cement 37. The cardboard frame 36, shown in FIGS. 4 and 5, which is shipped with the mailbox 11, is centered around the 4.00 inch post 21, water is mixed with a ready mix concrete and the mixture is poured into the frame 36 and leveled with the top of the frame 36. Before the concrete has set up, an adhesive or a thin set cement is applied to the square post 21 and the mailbox 11 is installed over the post 21 with the bottom of the mailbox 11 in contact with the fresh concrete.

Figure 14:
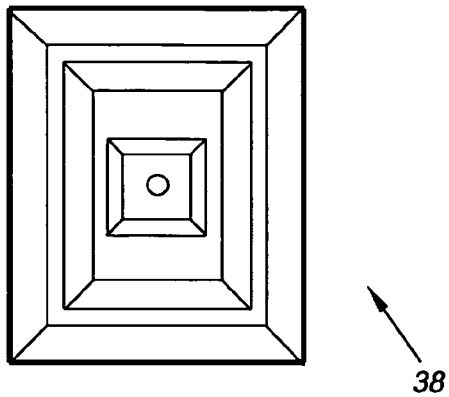
FIG. 14 is a plan view of the alternate embodiment.
Figure 12:
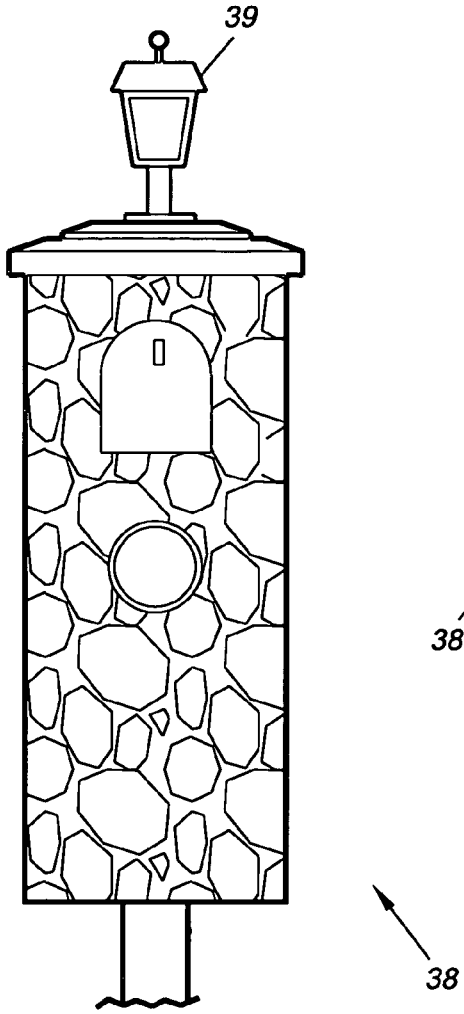
FIG. 12 is a front view of an alternate embodiment of my mailbox.
Figure 13:
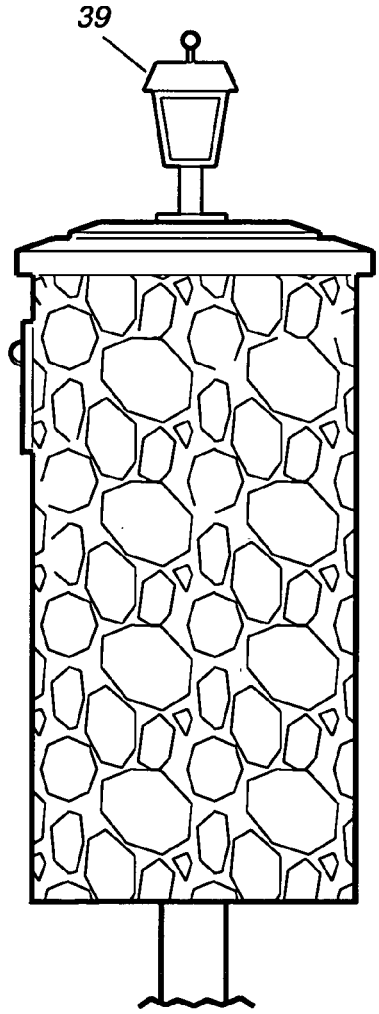
FIG. 13 is a left side elevational view of the alternate embodiment.

In FIGS. 12–14 an alternate embodiment 38 is shown with an optional masonry finish. A light 39 is mounted on the mailbox 38.

From the above, it is apparent that my mailbox provides numerous benefits over the prior art. One important benefit is that it reduces property damage and injuries caused by vehicle impacts with massive masonry roadside structures. Another important benefit is that it can be easily assembled and installed by homeowners and unskilled workers. Another important benefit is that a variety of styles can be provided without incurring significant manufacturing and inventory cost penalties. Still yet another benefit is that it is aesthetically pleasing and has the appearance of an expensive masonry mailbox.

Although only two embodiments of my invention have been illustrated and described, it is not my intention to limit the invention to the disclosed embodiments. It will be appreciated that other embodiments can be derived from my disclosure by changes which are obvious and/or well known to persons skilled in the relevant art, such as substitutions of materials and/or parts, elimination of parts, re-arrangements of parts and inversions of parts without departing from the spirit thereof.

What is claimed is:

1. A pre-fabricated lightweight roadside mailbox structure, comprising: a lightweight core made of a rigid plastic foam material, said core having a vertical aperture extending vertically upward from a bottom of said core for receiving a post and attaching said mailbox structure to the ground and a horizontal aperture for receiving a mail enclosure; a capital attached to an upper end portion of said core; a reinforcing cloth adhesively bonded to outer surfaces of said lightweight core; and an outer coating on said outer surfaces for simulating an appearance of a massive, immovable, roadside mailbox structure.

2. The pre-fabricated lightweight roadside mailbox structure recited in claim 1 wherein said outer coating simulates a massive, immovable, brick mailbox structure.

3. The pre-fabricated lightweight roadside mailbox structure recited in claim 1 wherein said outer coating simulates a massive, immovable, stone masonry mailbox structure.

4. The pre-fabricated lightweight roadside mailbox structure recited in claim 1 further comprising an additional horizontal aperture in said core for receiving a newspaper.

5. The pre-fabricated lightweight roadside mailbox structure recited in claim 1 wherein said lightweight core comprises a base made of said rigid plastic foam material and including said vertical aperture, and an upper mailbox housing adhesively joined to said base, said mailbox housing made of said rigid plastic foam material.

6. The pre-fabricated lightweight roadside mailbox structure recited in claim 1 further comprising a bracket mounted on said capital for displaying an address; and a visual representation of an address mounted in said bracket.

7. The pre-fabricated lightweight roadside mailbox structure recited in claim 1 further comprising a light mounted on said capital.

8. A pre-fabricated lightweight roadside mailbox structure, comprising: a lightweight core made of a rigid plastic foam material, said core having a base made of said rigid plastic foam material; an upper mailbox housing joined to said base and made of said rigid plastic foam material; a vertical aperture extending vertically upward from a bottom of said base for receiving a post and attaching said mailbox structure to the ground; a first horizontal in said upper mailbox housing aperture for receiving a mail enclosure; a second horizontal aperture in said upper mailbox housing for receiving a newspaper; a capital joined to an upper end portion of said upper mailbox housing; a reinforcing cloth adhesively bonded to outer surfaces of said lightweight core and said capital; and a coating on said outer surfaces of said core and said capital for simulating an appearance of a massive, immovable, roadside mailbox structure.

* * * * *